US008451213B2

(12) United States Patent
Chen

(10) Patent No.: US 8,451,213 B2
(45) **Date of Patent: *May 28, 2013**

(54) SYSTEM AND METHOD FOR ADJUSTING A BACKLIGHT LEVEL FOR A DISPLAY ON AN ELECTRONIC DEVICE

(75) Inventor: Joseph C. Chen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/274,905

(22) Filed: Oct. 17, 2011

(65) Prior Publication Data

US 2012/0038544 A1 Feb. 16, 2012

Related U.S. Application Data

(63) Continuation of application No. 12/039,836, filed on Feb. 29, 2008, now Pat. No. 8,063,873.

(51) Int. Cl.
*G09G 3/36* (2006.01)

(52) U.S. Cl.
USPC ..... 345/102

(58) Field of Classification Search
USPC ..... 345/102; 349/61–70; 362/561
See application file for complete search history.

(56) References Cited

U.S. PATENT DOCUMENTS

| | | | | |
|---|---|---|---|---|
| 2002/0021292 | A1 | 2/2002 | Sakashita | |
| 2004/0113906 | A1 * | 6/2004 | Lew et al. | 345/211 |
| 2004/0257324 | A1 | 12/2004 | Hsu | |
| 2005/0248592 | A1 | 11/2005 | Feng et al. | |
| 2007/0216616 | A1 * | 9/2007 | Stessen et al. | 345/84 |
| 2007/0279369 | A1 | 12/2007 | Yao et al. | |
| 2009/0201253 | A1 * | 8/2009 | Jason et al. | 345/168 |

FOREIGN PATENT DOCUMENTS

| | | | |
|---|---|---|---|
| EP | 1475772 | A1 | 11/2004 |
| WO | WO 2005/119639 | A1 | 12/2005 |

* cited by examiner

*Primary Examiner* — Chanh Nguyen
*Assistant Examiner* — Ram Mistry
(74) *Attorney, Agent, or Firm* — McCarthy Tétrault LLP

(57) ABSTRACT

The disclosure describes a device and method for adjusting a backlight for a display for an electronic device. The method comprises: identifying a highest brightness value for a pixel in an image to be generated on the display; determining a brightness headroom value for the image based on a difference between the highest brightness value and a maximum brightness level for the display; and if the brightness headroom value is determined to be larger than a predetermined threshold, then when an adjusted image based on the image is generated on the display having a brightness based on the brightness headroom, generating an adjusted backlight level for the backlight, the adjusted backlight level being based on a ratio of the highest brightness value to the maximum brightness level.

17 Claims, 4 Drawing Sheets

SYSTEM AND METHOD FOR ADJUSTING A BACKLIGHT LEVEL FOR A DISPLAY ON AN ELECTRONIC DEVICE

RELATED APPLICATION

This application is a continuation application of U.S. patent application Ser. No. 12/039,836 filed on Feb. 29, 2008, now U.S. Pat. No. 8,063,873.

FIELD OF TECHNOLOGY

The disclosure described herein relates to a system and method for adjusting a backlight level for a display on an electronic device. In particular, the disclosure described herein relates to determining the current brightness level of an image, adjusting the brightness level to incorporate any brightness headroom and then adjusting the backlight level for the image accordingly.

BACKGROUND

Current wireless handheld mobile communication devices perform a variety of functions to enable mobile users to stay up-to-date with information and communications, such as e-mail, corporate data and organizer information while they are away from their desks. A wireless connection to a server allows a mobile communication device to receive updates to previously received information and communications. The handheld devices optimally are lightweight, compact and have long battery life.

For a display of a device, a backlight system provides improved brightness for the image being displayed. However, the activation cycles of current backlight systems do not account for the current features of an image being generated on its display. This can cause over-use of the backlight system, thereby drawing excessive battery power from the device.

There is a need for a system and method which addresses deficiencies in the prior art.

BRIEF DESCRIPTION OF THE DRAWINGS

The disclosure and its embodiments will now be described, by way of example only, with reference to the accompanying drawings, in which.

DESCRIPTION OF EMBODIMENTS

Figure 1:
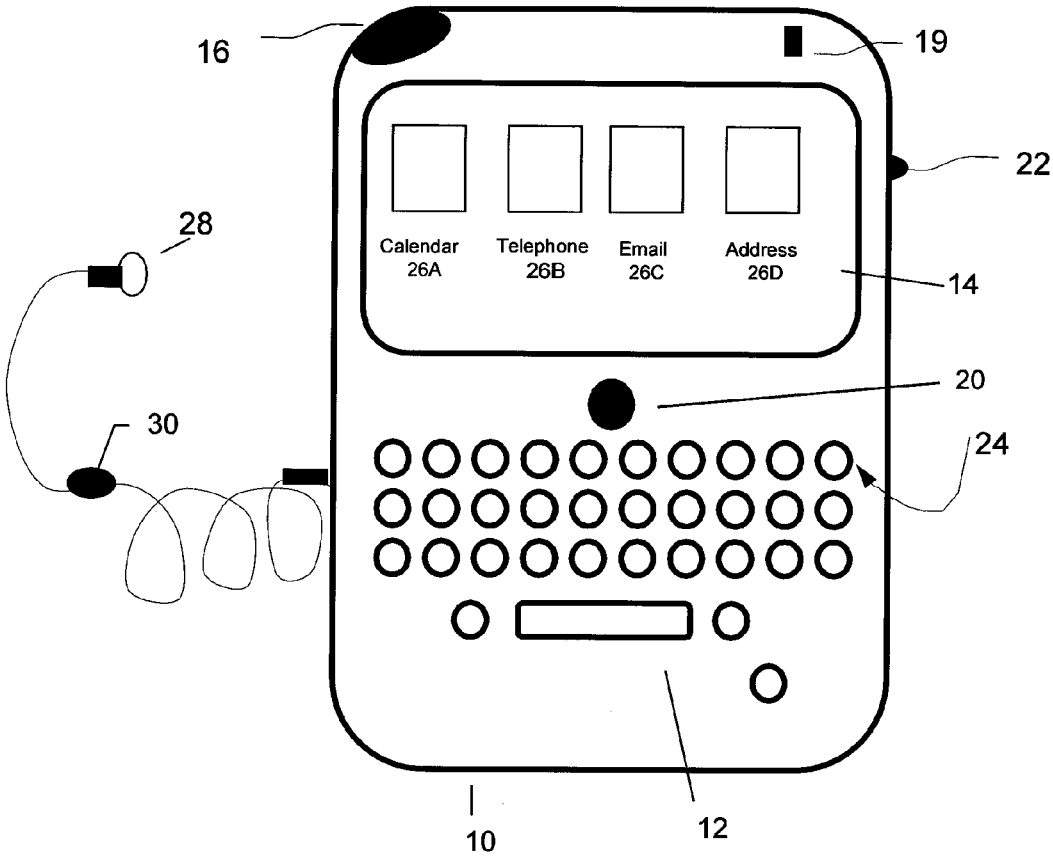
FIG. 1 is a schematic representation of an electronic device having a display and a background light adjustment system for the display in accordance with an embodiment.

The description which follows and the embodiments described therein are provided by way of illustration of an example or examples of particular embodiments of the principles of the present disclosure. These examples are provided for the purposes of explanation and not limitation of those principles and of the disclosure. In the description which follows, like parts are marked throughout the specification and the drawings with the same respective reference numerals.

In a first aspect, a method of adjusting an output for a backlight for a display of an electronic device is provided. The method comprises: identifying a highest brightness value for a pixel in an image to be generated on the display; determining a brightness headroom value for the image based on a difference between the highest brightness value and a maximum brightness level for the display; and if the brightness headroom value is determined to be larger than a predetermined threshold, then when an adjusted image based on the image is generated on the display having a brightness based on the brightness headroom, generating an adjusted backlight level for the backlight, the adjusted backlight level being based on a ratio of the highest brightness value to the maximum brightness level.

In the method, the highest brightness value may be identified by analyzing a predefined region of the image for the highest brightness value.

In the method, the predefined region may be selected from one of alternating rows and a central region in the display.

In the method, the highest brightness value may be identified when a pixel in the image having the highest brightness value is within a predetermined number of pixels to another pixel in the image having a brightness that is within a predetermined range of the highest brightness value.

In the method, the highest brightness value may be identified from a greyscale representation of the image and the greyscale representation has been adjusted according to a gamma value.

In the method, the greyscale representation may provide a weight to favour green values in the image.

The method may further comprise adjusting the adjusted backlight level to account for ambient light conditions surrounding the device.

In the method, the adjusted backlight may be increased as the ambient light conditions increase up to a certain point and is deactivated when the ambient conditions pass the certain point.

The method may further comprise repeating the method when the image is replaced by another image on the display and the another image contains changes over the image in more than a predetermined portion of the image.

In the method, the display may be displaying a video image; and the highest brightness value may be identified when a pixel in the image having the highest brightness value has a brightness value that is within a predetermined range of the highest brightness value in an image that is either before of after the image in the video image.

In a second aspect, an electronic device is provided. The electronic device comprises: a display for displaying images; an image processing module to identify a highest brightness value of a pixel in an image for generation on the display and to determine a brightness headroom value for the image based on a difference between the highest brightness value and a maximum brightness level for the display; a backlight adjustment module to provide an adjusted backlight level for the adjusted image, the adjusted backlight level being based on a ratio of the highest brightness value to the maximum brightness level; and a backlight system to provide a backlight for the display at the adjusted backlight level.

In the device, the adjusted backlight level may be decreased by a factor relating to a current backlight level for the backlight system and the brightness headroom.

In the device, the image processing module may scan at least a part of pixels in the image to identify the highest brightness value.

In the device, the image processing module may assess whether a pixel in the image having the highest brightness value is within a preset number of pixels to another pixel having a comparable brightness before identifying the highest brightness value as being represented by the pixel.

In the device, the highest brightness value may be identified from a greyscale representation of the image and the greyscale representation has been corrected according to a gamma curve.

In the device, the adjusted backlight level may be adjusted to account for an ambient light conditions obtained from a light sensor for the device to increase a current backlight level as the ambient light conditions increase up to a certain point and to deactivate the backlight when the ambient light conditions pass the certain point.

In another aspect, a method of adjusting a backlight for a display for an electronic device is provided. The method comprises: identifying a highest brightness value of an image for generation on the display; determining whether there is sufficient brightness headroom for the image based on the highest brightness value. If the brightness headroom is sufficient (for example, the highest brightness value is below a predetermined threshold), then the method adjusts the image to create an adjusted image where elements of the adjusted image are boosted in brightness from the image based on the brightness headroom; and generates the adjusted image on the display. In other words, after determining an amount of brightness headroom for said image based on said highest brightness value, if the brightness headroom is larger than a predetermined threshold, then the following may be done: create an adjusted image based on the image where elements of the adjusted image are boosted in brightness from the image based on the brightness headroom; generate the adjusted image on the display; and providing an adjusted backlight level for the adjusted image, the adjusted backlight level being lower than a backlight level for the image based on the brightness headroom. Finally, the method adjusts a backlight level to a lower adjusted backlight level for the adjusted image based on the brightness headroom.

Generally, it will be appreciated that the term "brightness" refers to a visual perception in which a source appears to emit a given amount of light. An object that appears to be brighter appears to emit more light than an object that is less bright. As such, brightness can be charted on a scale of brightness from low to high. The scale may or may not be linear. A brightness value is a numeric value that can be attributed to a particular brightness level in the scale. As such, a larger brightness value is "brighter" than a lower brightness value. A display in a device can have a brightness range. Images generated on the display will have brightness values for its pixels.

In the method, all pixels of the image may be scanned to identify the highest brightness value. Alternatively, in identifying the highest brightness value, a predefined region of the image may be analyzed. The region may be any section of the image, for example a predefined central region, a top region, a bottom region, a side region, etc.

In the method, a pixel in the image having the highest brightness value may be assessed on whether it is proximately close to another pixel having a comparable brightness in the image before identifying the highest brightness value as being the brightness of that pixel. In other words, in identifying the highest brightness value, a pixel in the image having said highest brightness value may be required to be within a predetermined distance to another pixel in the image having a brightness that is within a predetermined range of the highest brightness value in order to identify the highest brightness value as being represented by the pixel.

In the method, the adjusted image may be created in memory associated with the device and the adjusted image may be generated on the display instead of the image.

The method may further comprise generating the image on the display using the backlight level if the brightness headroom is not sufficient, for example if the headroom does not exceed a predetermined threshold.

In the method, the highest brightness value may be identified from a greyscale representation of the image and the greyscale representation may be corrected according to a gamma value.

In the method, the greyscale representation may provide a weight to favour colour values in the image. The weight may be provided according to data relating to sensitivity of the user's eye towards those certain colour values. Further, an adjustment may be made to account for the ambient light in the environment of the device.

The method may be repeated for another image when the image is replaced by that image and that image has changes over the image over more than a predetermined region of the image. Additionally, the display may be displaying a video image or moving image comprising the image. In identifying the highest brightness value in a such a moving image, a pixel in the image having the highest brightness value may be required to have a brightness value that is within a predetermined range of the highest brightness value in an image that is either before of after that image in a stream of images in order to identify that highest brightness value as being represented by that pixel.

The method may further comprise adjusting the adjusted backlight level to account for an ambient light reading relating to an environment of the device.

In a second aspect, an electronic device is provided. The device comprises: a display for displaying images; an image processing module; an image generation module; a backlight adjustment module; and a backlight system. The image processing module: identifies a highest brightness value for an image for generation on the display; identifies an amount of brightness headroom for the image based on the highest brightness value; and when the brightness headroom is sufficient (for example when it exceeds a predetermined threshold), creates an adjusted image based on the image for generation on the display where elements of the adjusted image are boosted in brightness from the image based on the brightness headroom. The image generating module generates the adjusted image on the display. The backlight adjustment module adjusts a backlight level associated with the image to a lower adjusted backlight level for the adjusted image based on the brightness headroom. The backlight system provides a backlight for the display, responsive to control signals generated by the backlight adjustment module.

In the device, the lower adjusted backlight level may be decreased by a factor relating to the current backlight level and said brightness headroom.

In the device, the adjusted image may be boosted by a factor relating to an original brightness value of pixel and said brightness headroom.

In the device, the image processing module may scan at least part of the pixels of the image to identify the highest brightness value.

In the device, the image processing module may assess whether a pixel in the image that has the highest brightness value is proximately close to another pixel having a comparable brightness in the image before identifying the highest brightness value as being represented by that pixel.

In the device, the image processing module may create the adjusted image in memory associated with the device and the image is not generated on the display.

In the device, if the brightness headroom is not sufficient, the (original) image may be generated on the display with the backlight level.

In the device, the highest brightness value may be identified from a greyscale representation of the image and the greyscale representation may be corrected according to a gamma curve.

In the device, the greyscale representation may provide a weight to favour colour values in the image according to the sensitivity of the user's eye towards those certain colour values, which may also account for the ambient light in the environment of the device.

In the device, the image processing module may process another image when the image is replaced by another image on the display and another image has changes over the image over more than a small portion of the image. Further, in the device, the display may be displaying a video image comprising the image and another image.

The device may further comprise a light sensor and the adjusted backlight level may be further adjusted to account for an ambient light reading obtained from the light sensor.

In other aspects, various sets and subsets of the above noted aspects are provided.

Referring to FIG. 1, an electronic device for receiving electronic communications in accordance with an embodiment of the disclosure is indicated generally at 10. In the present embodiment, electronic device 10 is based on a computing platform having functionality of an enhanced personal digital assistant with cellphone and e-mail features. It is, however, to be understood that electronic device 10 can be based on construction design and functionality of other electronic devices, such as smart telephones, desktop computers pagers or laptops having telephony equipment. In a present embodiment, electronic device 10 includes a housing 12, a display 14 (which may be a liquid crystal display or LCD), speaker 16, a light emitting diode (LED) indicator 19, a trackball 20, an ESC ("escape") key 22, keypad 24, a trackwheel (not shown) a telephone headset comprised of an ear bud 28 and a microphone 30. Trackball 20 and ESC key 22 can be inwardly depressed as a means to provide additional input signals to device 10.

It will be understood that housing 12 can be made from any suitable material as will occur to those of skill in the art and may be suitably formed to house and hold all components of device 10.

Device 10 is operable to conduct wireless telephone calls, using any known wireless phone system such as a Global System for Mobile Communications (GSM) system, Code Division Multiple Access (CDMA) system, CDMA 2000 system, Cellular Digital Packet Data (CDPD) system and Time Division Multiple Access (TDMA) system. Other wireless phone systems can include Wireless WAN (IMS), Wireless MAN (Wi-max or IEEE 802.16), Wireless LAN (IEEE 802.11), Wireless PAN (IEEE 802.15 and Bluetooth), etc. and any others that support voice. Additionally, a Bluetooth network may be supported. Other embodiments include Voice over IP (VoIP) type streaming data communications that can simulate circuit-switched phone calls.

Various applications are provided on device 10, including email, telephone, calendar and address book applications. A graphical user interface (GUI) providing an interface to allow entries of commands to activate these applications is provided on display 14 through a series of icons 26. Shown are calendar icon 26A, telephone icon 26B, email icon 26C and address book icon 26D. Such applications can be selected and activated using the keypad 24 and/or the trackball 20. Further detail on selected applications is provided below.

Figure 2:
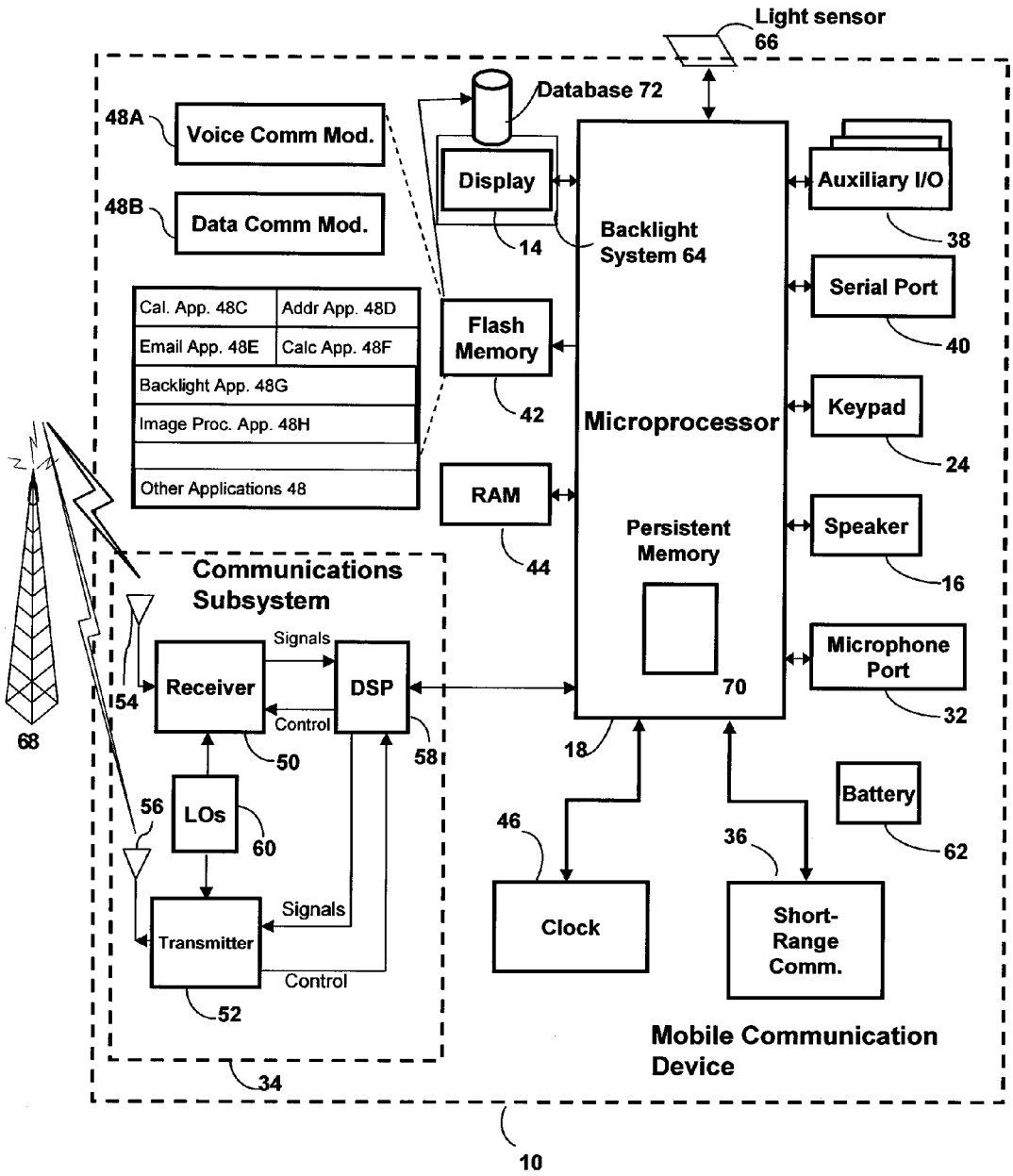
FIG. 2 is a block diagram of internal components of the device of FIG. 1 including the display and the background light adjustment system.

Referring to FIG. 2, functional elements of device 10 are provided. The functional elements are generally electronic or electro-mechanical devices. In particular, microprocessor 18 is provided to control and receive almost all data, transmissions, inputs and outputs related to device 10. Microprocessor 18 is shown schematically as coupled to keypad 24, display 14 and other internal devices. Microprocessor 18 controls the operation of the display 14, as well as the overall operation of the device 10, in response to actuation of keys on the keypad 24 by a user. Microprocessor 18 preferably controls the overall operation of the device 10 and its components. Exemplary microprocessors for microprocessor 18 include microprocessors in the Data 950 (trade-mark) series, the 6200 series and the PXA900 series, all available at one time from Intel Corporation.

In addition to the microprocessor 18, other internal devices of the device 10 include: a communication subsystem 34; a short-range communication subsystem 36; keypad 24; and display 14; with other input/output devices including a set of auxiliary I/O devices through port 38, a serial port 40, a speaker 16 and a microphone port 32 for microphone 30; as well as memory devices including a flash memory 42 (which provides persistent storage of data) and random access memory (RAM) 44; clock 46 and other device subsystems (not shown). The device 10 is preferably a two-way radio frequency (RF) communication device having voice and data communication capabilities. In addition, device 10 preferably has the capability to communicate with other computer systems via the Internet.

Operating system software executed by microprocessor 18 is preferably stored in a computer readable medium, such as flash memory 42, but may be stored in other types of memory devices (not shown), such as read only memory (ROM) or similar storage element. In addition, system software, specific device applications, or parts thereof, may be temporarily loaded into a volatile storage medium, such as RAM 44. Communication signals received by the mobile device may also be stored to RAM 44. Database 72 may be provided in flash memory 42 to store images, variables and run time data relating to applications 48.

Microprocessor 18, in addition to its operating system functions, enables execution of software applications on device 10. A set of software applications 48 that control basic device operations, such as a voice communication module 48A and a data communication module 48B, may be installed on the device 10 during manufacture or downloaded thereafter.

Communication functions, including data and voice communications, are performed through the communication subsystem 34 and the short-range communication subsystem 36. Collectively, subsystem 34 and subsystem 36 provide the signal-level interface for all communication technologies processed by device 10. Various other applications 48 provide the operational controls to further process and log the communications. Communication subsystem 34 includes receiver 50, transmitter 52 and one or more antennas, illustrated as receive antenna 54 and transmit antenna 56. In addition, communication subsystem 34 also includes processing module, such as digital signal processor (DSP) 58 and local oscillators (LOs) 60. The specific design and implementation of communication subsystem 34 is dependent upon the communication network in which device 10 is intended to operate. For example, communication subsystem 34 of the device 10 may be designed to operate with the Mobitex (trade-mark), DataTAC (trade-mark) or General Packet Radio Service (GPRS) mobile data communication networks and also designed to operate with any of a variety of voice communication networks, such as Advanced Mobile Phone Service (AMPS), Time Division Multiple Access (TDMA), Code Division Multiple Access CDMA, Personal Communication Service (PCS), Global System for Mobile Communication (GSM), etc. Communication subsystem 34 provides device 10 with the capability of communicating with other devices using various communication technologies, including instant messaging (IM) systems, text messaging (TM) systems and short message service (SMS) systems.

In addition to processing communication signals, DSP 58 provides control of receiver 50 and transmitter 52. For example, gains applied to communication signals in receiver 50 and transmitter 52 may be adaptively controlled through automatic gain control algorithms implemented in DSP 58.

In a data communication mode a received signal, such as a text message or web page download, is processed by the communication subsystem 34 and is provided as an input to microprocessor 18. The received signal is then further processed by microprocessor 18 which can then generate an output to the display 14 or to an auxiliary I/O port 38. A user may also compose data items, such as e-mail messages, using keypad 24, trackball 20, or a thumbwheel (not shown), and/or some other auxiliary I/O device connected to port 38, such as a touchpad, a rocker key, a separate thumbwheel or some other input device. The composed data items may then be transmitted over communication network 68 via communication subsystem 34.

In a voice communication mode, overall operation of device 10 is substantially similar to the data communication mode, except that received signals are output to speaker 16, and signals for transmission are generated by microphone 30. Alternative voice or audio I/O subsystems, such as a voice message recording subsystem, may also be implemented on device 10.

Short-range communication subsystem 36 enables communication between device 10 and other proximate systems or devices, which need not necessarily be similar devices. For example, the short-range communication subsystem may include an infrared device and associated circuits and components, or a Bluetooth (trade-mark) communication module to provide for communication with similarly-enabled systems and devices.

Powering the entire electronics of the mobile handheld communication device is power source 62 (shown in FIG. 2 as a battery). Preferably, the power source 62 includes one or more batteries. More preferably, the power source 62 is a single battery pack, especially a rechargeable battery pack. A power switch (not shown) provides an "on/off" switch for device 10. Upon activation of the power switch an application 48 is initiated to turn on device 10. Upon deactivation of the power switch, an application 48 is initiated to turn off device 10. Power to device 10 may also be controlled by other devices and by internal software applications.

Display 14 has backlight system 64 to assist in the viewing display 14, especially under low-light conditions. A backlight system is typically present in a LCD. A typical backlight system comprises a lighting source, such as a series of LEDs or a lamp located behind the LCD panel of the display, and a controller to control activation of the lighting source. The lamp may be fluorescent, incandescent, electroluminescent or any other suitable light source. As the lighting sources are illuminated, their light shines through the LCD panel providing backlight to the display. The intensity of the backlight level may be controlled by the controller by selectively activating a selected number of lighting sources (e.g. one, several or all LEDs) or by selectively controlling the activation duty cycle of the activated lighting sources (e.g. a duty cycle anywhere between 0% and 100% may be used). The activation cycle may be controlled through a series of time analog signals or a digital pulse train, such as a pulse-width modulation (PWM) signal. As will be described in more detail below, backlight system 64 can be made responsive to signals from a software module that determines a new brightness level for an image.

Light sensor 66 is provided on device 10. Sensor 66 is a light sensitive device which converts detected light levels into an electrical signal, such as a voltage or a current. It may be located anywhere on device 10, having considerations for aesthetics and operation characteristics of sensor 66. In one embodiment, an opening for light to be received by sensor 66 is located on the front cover of the housing of device 10 to reduce the possibility of blockage of the opening. In other embodiments, multiple sensors 66 may be provided and the software may provide different emphasis on signals provided from different sensors 66. The signal(s) provided by sensor(s) 66 can be used by a circuit in device 10 to determine when device 10 is in a well-lit, dimly lit or moderately-lit environment. This information can then be used to control backlight levels for display 14. In some embodiments, LED indicator 19 may be also used as a light sensor.

Brief descriptions are provided on the applications 48 stored and executed in device 10. The applications may also be referred to as modules and may include any of software, firmware and hardware to implement a series of commands and instructions to carry out their functions. Voice communication module 48A and data communication module 48B have been mentioned previously. Voice communication module 48A handles voice-based communication such as telephone communication, and data communication module 48B handles data-based communication such as e-mail. In some embodiments, one or more communication processing functions may be shared between modules 48A and 48B. Additional applications include calendar 48C which tracks appointments and other status matters relating to the user and device 10. Calendar 48C is activated by activation of calendar icon 26A on display 14. It provides a daily/weekly/month electronic schedule of appointments, meetings and events entered by the user. Calendar 48C tracks time and day data for device 10 using processor 18 and internal clock 46. The schedule contains data relating to the current accessibility of the user. For example it can indicate when the user is busy, not busy, available or not available. In use, calendar 48C generates input screens on display 14 prompting the user to input scheduled events through keypad 24. Alternatively, notification for scheduled events could be received via an encoded signal in a received communication, such as an e-mail, SMS message or voicemail message. Once the data relating to the event is entered, calendar 48C stores processes information relating to the event; generates data relating to the event; and stores the data in memory in device 10.

Address book 48D enables device 10 to store contact information for persons and organizations. Address book 48D is activated by activation of address book icon 26D on display 14. Names, addresses, telephone numbers, e-mail addresses, cellphone numbers and other contact information are stored. The data can be entered through keypad 24 and is stored in an accessible database in non-volatile memory, such as persistent storage 70 or flash memory 42, which are associated with microprocessor 18, or any other electronic storage provided in device 10. Persistent memory 70 may be a separate memory system to flash memory 42 and may be incorporated into a device, such as in microprocessor 18. Additionally or alternatively, memory 70 may removable from device 10 (e.g. such as a SD memory card), whereas flash memory 42 may be permanently connected to device 10.

Email application 48E provides modules to allow user of device 10 to generate email messages on device 10 and send them to their addressees. Application 48E also provides a GUI which provides a historical list of emails received, drafted, saved and sent. Text for emails can be entered through keypad 24. Email application 48E is activated by activation of email icon 26C on display 14.

Calculator application 48F provides modules to allow user of device 10 to create and process arithmetic calculations and display the results through a GUI.

Backlight adjustment application 48G provides the control signals to adjust the backlight level for display 14. When a calculation of the brightness of the image is found, the brightness of the image may be further adjusted/increased to enhance its brightness. Subsequently, a backlight level set to a lower level to have the effect of offsetting the increased brightness of the adjusted image and recalibrating the overall brightness of the adjusted image to be at or near the brightness of the original image. As such, when an adjusted image is displayed on display 14, the backlight level can be lower than the backlight level for the original image, thereby saving power. The backlight adjustment application 48G can generate an appropriate signal, such as a pulse width modulation (PWM) signal or values for a PWM signal, that can be used to drive a backlight in backlight system 64 to an appropriate level as determined from the above noted calculations. If backlight system 64 utilizes a duty cycle signal to determine a backlight level, application 48G can be modified to provide a value for such a signal, based on inputs received. Further detail on calculations conducted by application 48G are provided below.

Image processing application 48H is an image processing module and includes instructions that assist in processing an image that is about to be displayed on display 14 to be analyzed for its brightness. Application 48H scans an image that is being generated or is about to be generated on display 14 and determines the amount of brightness headroom available for the image, relative to the display. The source of the image may be from any other application 48. For example, it may be a default GUI of the main operating system of device 10. Application 48H can then create an adjusted image having an increased brightness compared to the original image for generation on display 14. All or parts of images and data processed by application 48H may be stored and updated in database 72.

Further detail is now provided on notable aspects of an embodiment. An embodiment provides a system and method for dynamically adjusting the lighting intensity of the backlight on display 14. The level of light (i.e. brightness) that is perceived by a user viewing display 14 is a product of the degree of modulation by the LCD elements of display 14. When none of the LCD elements are activated (i.e. "on"), they do not impose a transmissive barrier between the backlight and the output of display 14. As such the backlight may be generating more light than what is needed or perceived by the user. As such an embodiment provides a system and method that adjusts the output level of the backlighting and increases the transmissivity of the LCD elements, such that the overall perceived brightness between the original image and the adjusted image is about the same. In the meantime, less power is consumed by the backlight system, thereby conserving the battery power.

Image processing application 48H provides an analysis of the brightness of an image that is being or is to be generated on display 14. Backlight system 64 provides the lighting means to vary the intensity of the backlight provided to display 14. Backlight adjustment application 48G controls the intensity of the backlight using brightness data relating to an adjusted image that generated on display 14. As such, an embodiment provides a power-efficient method of generating an image with a predetermined brightness, but using less backlighting, thereby reducing power consumption for backlight system 64. An exemplary process to implement an embodiment is described below, where different steps are executed by one or more of image processing application 48H and backlight adjustment application 48G.

Figure 3:
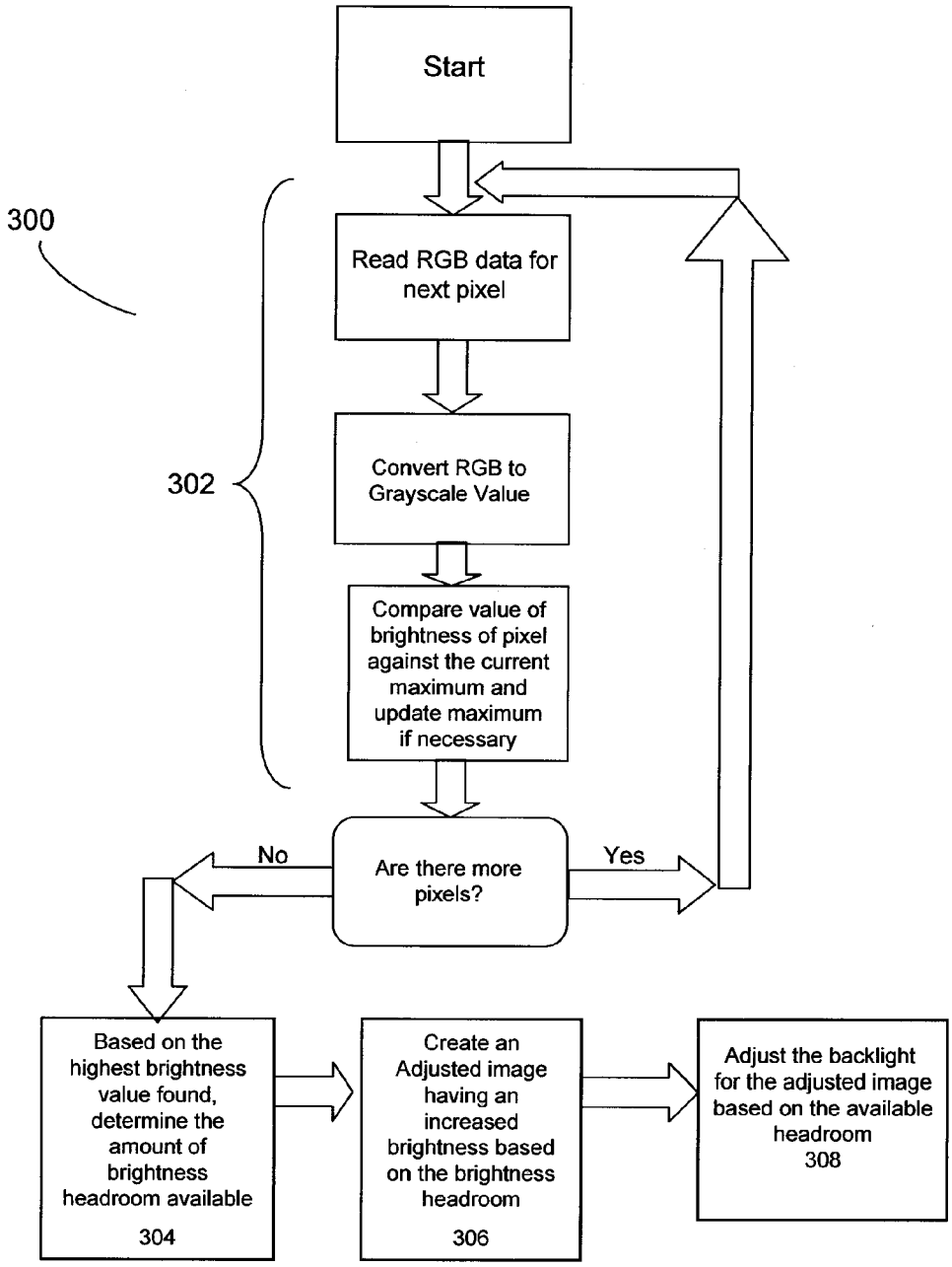
FIG. 3 is a flow chart of an algorithm executed by the backlight adjustment system of FIG. 1.

Referring to FIG. 3, algorithm 300 of an embodiment includes the following steps: first at step 302, determine a value of the most brightness of any element in an image being generated or about to be generated on display 14; next at step 304, determine how much brightness "headroom" exists between the element having the highest value of brightness in the image and the maximum brightness level for display 14; next at step 306, adjust the brightness of the image upward (brighter) to use at least some of that headroom; and finally at step 308 adjust a backlight level (downward, darker) for the image based on the headroom, thereby offsetting the increased brightness provided in the adjusted image. The adjustment may or may not be made, depending on whether the headroom exceeds a predetermined threshold. For example, the current brightness level may already be at the maximum brightness level for the display or there may be other limitations (perhaps relating technical, physical or computational issues) which may impede the ability to adjust the brightness level to an intended level. Preferably, the offset is determined such that the overall brightness of the image compared to the adjusted image and the adjusted backlight is the same or within tolerable differences over or below the original brightness. Each section is described in turn.

For step 302, various data analysis techniques may be used to identify and determine a displayed element (such as a pixel or group of pixels) having the highest brightness value for an image being generated on display 14. One method is to scan each pixel element in the image and compare each pixel's brightness level against a current maximum brightness value. If the brightness value of the current pixel is greater than the stored current maximum, then the brightness of the current pixel becomes the current maximum. One method of determining brightness level is the weighted greyscale method as described earlier. Additional exemplary methods and algorithms include, but are not limited to, computing the ANSI luminance, the NTSC luma computation, or estimating the direct current (DC) luminance of an MPEG block, and others known to a person of skill in the art.

As the display 14 produces images in colour, one method of determining the brightness of its elements is to convert the net colour value for the image into a greyscale value and then analyse the brightness of the greyscale value. For example, in a given image a pixel that is green at a given intensity is more luminous that a pixel that is red at the same intensity. By converting all colour values for all pixels to a greyscale, such differences can be smoothed out, since during the conversion process, the luminosity of different colours is preferably taken into consideration. It will be appreciated that providing appropriate weighting values to one or more of the colour components in the greyscale computation can be used to smooth out such differences.

Further detail on a greyscale conversion is provided. In an exemplary display 14 in device 10, a colour format used is RGB 565, meaning that there are 32 levels of resolution for red in five bits, 64 levels for green in six bits and 32 levels for blue in five bits. For the greyscale conversion, a first step is to drop the least significant bit (LSB) of the green pixel, in order to normalize all bit values for the red, green, and blue colours. As such, each of the three colours is represented by a number between 0-31. Next, the values for the three colours are converted into a single greyscale value by a weighted calculation. The weighting of each pixel colour is based on the photopic curve. The human eye does not perceive all wavelengths of light equally: generally green wavelengths are perceived to be more intense than red and blue wavelengths. Therefore when converting a red-green-blue image to a greyscale image, the green value in the image is preferably most heavily weighted. A commonly used weighting, often referred to as the NTSC Standard, is provided in Equation 1:

$$\text{GRAY}=0.3\times\text{RED}+0.59\times\text{GREEN}+0.11\times\text{BLUE} \qquad \text{Equation 1}$$

It can be seen that the green value is most heavily weighted with a scaling factor of 0.59, the red value is next most heavily weighted with a scaling factor of 0.3 and the blue value is least heavily weighted with a scaling factor of 0.11. In other embodiments, other scaling factors may be used. Scaling factors may be considered in view of other factors, such as available computational power of a related graphics processing engine, the type of content being decoded, etc., and this computation may be a determining factor of for throughput.

Next, the value of the intensity may be adjusted using a gamma curve correction factor. A gamma curve can be used to correct the brightness of all pixel colours lying between white and black. The gamma curve is provided in Equation 2:

$$y=\left(\frac{x}{\text{MAX}}\right)^{\gamma} \qquad \text{Equation 2}$$

where y is the gamma-corrected pixel value, x is the original pixel value, MAX is the maximum pixel value and $\gamma$ is the gamma correction value. For the instance of a pixel having 5-bit colour resolution, MAX is 31. The gamma value of a typical LCD is about 2.2. In order to simplify mathematical calculations, a gamma value of may be used 2: calculating a non-integral power (e.g., $x^{2.2}$) requires more calculations and longer time than calculating an integral power (i.e., $x^2$). However, if an embodiment has sufficient processing power, other values may also be used.

Next, the greyscale value can be converted into a percentage based on a minimum brightness level (the level that would be set for a completely white image) and a maximum brightness level (the level that would be set for a completely black image). Between the minimum and maximum levels, a parabolic curve is used to determine a brightness of all images between white and black. The curve may be based on the gamma curve, as known in the art.

In determining the highest brightness value, an algorithm may implement thresholds and/or conditions on the analysis of each pixel. For one condition, the brightest pixel may not be marked as such unless it is sufficiently proximately close to another pixel having a comparable brightness (which may be relative to the brightest pixel) in the image before identifying the highest brightness value as being represented by the pixel. This would have the effect of discounting isolated bright pixels from the analysis. For this condition, a pixel having the highest brightness value may be identified as such only if it is part of a connected region of a predetermined minimum size having one or more of pixels therein having a certain brightness level. Sufficient proximity may be preset to a number of pixels (e.g. less than 100). If the pixel having the highest brightness value does not have a neighbour that is close enough and bright enough, then an embodiment may repeat the assessment for a pixel having a lower brightness level than the highest brightness level. Alternatively, it may attempt to find a bright pixel in a different region and repeat the analysis for that region.

Several variations may be provided based on such thresholds. One set of variations provides locality thresholds. Therein, a pixel in the image having the highest brightness value may be required to be within a predetermined distance to another pixel in the image and that another pixel would need to have a brightness that is within a predetermined range of the highest brightness value in order to identify the first pixel's brightness value as being the highest brightness value. Additionally or alternatively, if a predetermined number of isolated pixels have the brightest value, then their brightness value may be taken as the brightest value for the image. Another set of variations provides temporal thresholds. Therein, for a series of images, one condition used to determine the brightest pixel would be to require that in the next (or previous) image (or number of images), that pixel would need to have a brightness value that is within a predetermined range before that pixel is determined to be the brightest pixel. Temporal and locality thresholds may be combined.

Once the highest brightness value has been identified, it may be stored for further use by an embodiment. For the purposes of illustration, the highest brightness value is identified by:

$$\text{Highest brightness value in an original image}=b \qquad \text{Equation 3}$$

The highest brightness value further adjusted (higher or lower) by a predetermined value and/or factor.

The embodiment described herein provides an intensity calculation based on the entire display section of display 14. In other embodiments, different sections of display 14 may be used to identify "highest" values for the brightness values. For example, the brightest pixels may be calculated based on alternating rows in display 14 or on a specific section of display 14 (e.g. its central area, its top, its bottom, its sides, etc.). Other calculations may use only one or two of the colours (e.g. green and red, as they are two dominant colours). In other embodiments a combination of any of these alternative calculations may be used.

It will be appreciated that the embodiment can be used on monochrome displays. Therein, a greyscale value is already provided for the image being displayed on display 14.

In other embodiments, the intensity calculation provided above can be used with ambient lighting condition information provided by sensor 66 to make further adjustments to the intensity level.

For step 304, once the highest brightness value is determined, the remaining brightness headroom for display 14 can be calculated. Display 14 has a predetermined maximum brightness value associated with it. Different displays may have different values. For the purposes of illustration, the maximum brightness value for a display is set to:

$$\text{Maximum brightness value producible on display } 14=B \qquad \text{Equation 4}$$

where B>b

The maximum brightness level may be further adjusted by a predetermined value and/or factor.

It will be appreciated that there are operational conditions, thresholds and other parameters may be imposed on how a maximum brightness value is tracked and determined for a given image. For example, once a certain maximum value is identified, that value may be accepted as the noted maximum value. Alternatively, an average brightness for the image may be calculated and used instead of the maximum value. Alternatively or additionally still, brightness may be identified in discrete bands of intensity.

As such, the available brightness headroom for an image having its highest brightness value as "b" on a display having a maximum brightness of "B" is:

$$\text{Brightness headroom } H(b)=(B-b) \qquad \text{Equation 5}$$

The brightness level may be further adjusted by a predetermined value and/or factor.

For step 306, with the above noted data stored relating to Equations 3 to 5, each pixel (or selected pixels from a predetermined region) in the image can be adjusted to increase its relative brightness according to a scale related to the available brightness headroom H(b). Presuming that the maximum headroom available is used, the adjustment value for the pixels would be $$\text{Brightness boost} = \text{original brightness value of pixel} \times \frac{H(b)}{b} \qquad \text{Equation 6}$$

As such, the brightness of each pixel in the image has been scaled such that the entire image has brightness values that span the entire brightness spectrum for display 14. It will be appreciated that Equation 6 may be amended to include additional scaling factors or offsets (where a predetermined brightness amount is added or subtracted) to adjust the brightness boost up or down, as needed. As with the determination of the maximum brightness value, there are operational conditions, thresholds and other parameters may be imposed on how the boost level is determined, following similar parameters and ranges identified above. It is further appreciated that the brightness boost may be applied to selected regions of the original image. For example, the boost may be applied to only one or more of a central region, a top portion, a bottom portion, and/or sides of the image.

The data relating to the boosted pixels can be generated on as an adjusted image is being processed ("on the fly") for display or can be stored in database 72 and then provided to display 14 in a later data transmission or image dump.

For step 308, once the brightness of the original image has been adjusted, the backlight level of display 14 may be decreased. While the backlight level can be decreased by any amount, factor or offset, one embodiment adjusts the level downward to offset the increase in brightness made by the brightness boost per Equation 6. As such, the backlight level may be decreased by a factor of:

$$\text{Backlight decrease factor} = \text{Current backlight level} \times \frac{b}{B} \qquad \text{Equation 7}$$

The decrease factor may be further augmented by a preset factor and/or offset (either higher or lower)

It will be appreciated that the granularity for controlling the backlight level may not align with the granularity of the brightness values for display 14. Using the factor of "b/B" will address any differences. As with Equation 6, it will be appreciated that Equation 7 may be amended to include additional scaling factors or offsets to adjust the decrease factor up or down, as needed. Again, as noted above, there are operational conditions, thresholds and other parameters may be imposed on how the backlight adjustment level is set, following similar parameters and ranges identified above.

Once the decrease factor has been calculated, control signals for the backlight system 64 are provided by application 48G to backlight system (e.g. as a PWM signal or a duty cycle signal), and backlight system 64 provides a backlight intensity corresponding to the signal provided. Data relating to the backlight levels and adjustments made thereto may be stored in database 72 and accessed by one or more of applications 48. At the same time, the adjusted image may be written to display 14.

As long as the adjusted image remains generated on display 14, the backlight level preferably remains at its adjusted level. For video images (or a series of related images in for example, a computer generated animation), an embodiment can utilize the same techniques described herein on an image frame-by-frame basis. A video image or computer generated moving image can be represented by a stream of images. In identifying the highest brightness value in an moving image, a pixel in a particular frame in the stream having said highest brightness value can be required to have a brightness value that is within a predetermined range for the image that is either before of after the current image in the stream.

Alternatively, for video or moving image applications, the backlight calculations may be done on a fixed periodic basis, for example, once every 2, 3, 5, 10, 15, 20, 30 . . . frames; or on a frame basis, which may or may not have fixed periodicity, based on the video CODEC used; or other bases which may or may not have fixed periodicity, which is determined in part from data from the video stream. Many CODECs only contain complete frame data only for one frame in an interval. Subsequent frames in the interval are composites of these full-data frames.

It will further be appreciated that for an electronic device, several static images may be displayed on device 10, even though minimal activity is apparent on device 10. For example, for a device that has a moveable displayed cursor, each instance of a movement of the cursor would cause a new image to be generated on display 14. As such, a new calculation may be done for each updated image. Also, a display on device 14 having a clock signal would be updated each time a digit changed on the clock signal. For such instances, if the change in the image affects only a relatively small portion of the entire screen, the system may selectively not conduct a recalculation of the intensity of the image. To illustrate, if the change is in a portion that represents less than, for example about 35% of the screen (although the percentage can range between 1 and 100%), or is localized to a predefined region of the screen (e.g. top, middle, bottom, sides, etc.), the embodiment may selectively not conduct a recalculation of the brightness of the image. A predefined region may be of any size and any location in display 14. For example, a predefined region may be where clock information is generated on display 14 or another area where predetermined "minor" updates to images or information is frequently provided to display 14.

Figure 4:
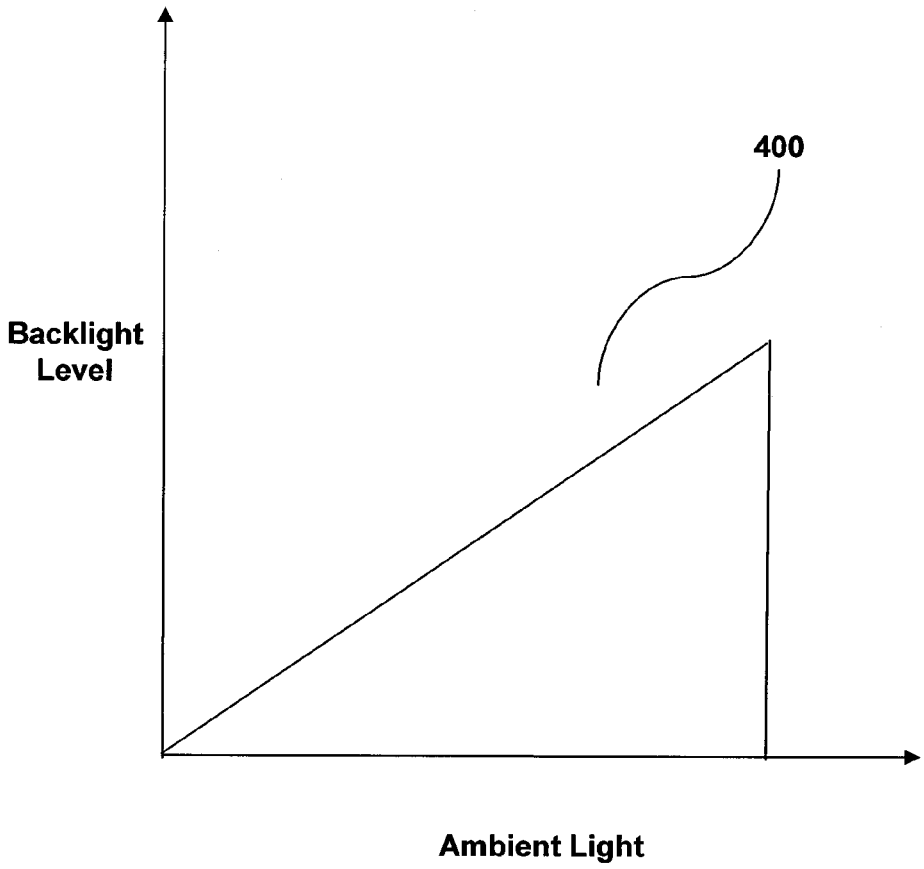
FIG. 4 is a graph illustrating a backlight intensity level for various ambient lighting conditions used by an embodiment of FIG. 1.

Referring to FIG. 4, as a further feature, an embodiment may generate an adjusted image as described above and adjust the backlight level and further adjust the backlight level to accommodate for the ambient lighting conditions surrounding device 10. Graph 400 shows a backlight level for display 14 on the y-axis compared against a level of ambient light of an environment surrounding device 14 on the x-axis, which can be detected by light sensor 66, preferably with updated values. As is shown, graph 400 has in a low backlight level when display 14 is in a very dark environment. As the amount of ambient light increases, the backlight level increases as well. Graph 400 provides a linear increase in backlight level intensity to as the amount of ambient light increases. The amount of backlighting calculated for an adjusted image may be further adjusted to accommodate for the ambient light reading. At a certain point, the ambient light conditions are very bright and as such, the backlight may not be very effective in those conditions. As shown in graph 400, at that point, backlighting may be turned off. A backlight level progression may be expressed as a formula, which may be used by software to determine an appropriate control signal for the controller of the backlight system for a given level of ambient light. In other embodiments, a backlight level progression may be stored as a table providing a set of backlight levels for a corresponding set of ambient light levels. In other embodiments, a series of different adjustment algorithms may be used. Processes to monitor ambient light signals as described may be incorporated into any application, such as backlight control application 48G.

In other embodiments, as a variation on FIG. 4, the backlight may be adjusted according to a non-linear curve (not shown) or progression. Therein, the progression may have plateaus, dips and peaks in its progression from a dark ambient light level to a bright ambient light level. The progression in one embodiment is preferably monotonically increasing, where the backlight level generally increases as ambient light increases. In other embodiments for other LCDs, other graphs of backlight level progressions may be used, including stepwise progressions and other non-linear progressions.

It will be appreciated that image processing application 48H, backlight adjustment application 48G and other applications in the embodiments can be implemented using known programming techniques, languages and algorithms. The titles of the applications are provided as a convenience to provide labels and assign functions to certain application. As noted earlier, an application may also be referred to as a module. It is not required that each application perform only its functions as described above. As such, specific functionalities for each application may be moved between applications or separated into different applications. Applications may be contained within other applications. Different signalling techniques may be used to communicate information between applications using known programming techniques. Known data storage, access and update algorithms allow data to be shared between applications. It will further be appreciated that other applications and systems on device 10 may be executing concurrently with any application 48. As such, image processing application 48H and backlight adjustment application 48G may be structured to operate in as "background" applications on device 10, using programming techniques known in the art.

As used herein, the wording "and/or" is intended to represent an inclusive-or. That is, "X and/or Y" is intended to mean X or Y or both.

The present disclosure is defined by the claims appended hereto, with the foregoing description being merely illustrative of a preferred embodiment of the disclosure. Those of ordinary skill may envisage certain modifications to the foregoing embodiments which, although not explicitly discussed herein, do not depart from the scope of the disclosure, as defined by the appended claims.

The invention claimed is:

1. A method of adjusting an output for a backlight for a display of an electronic device, comprising:

identifying a highest brightness value for a pixel in an image to be generated on the display;

determining a brightness headroom value for the image based on a difference between the highest brightness value and a maximum brightness level for the display; and if the brightness headroom value is determined to be larger than a predetermined threshold, then when an adjusted image based on the image is generated on the display having a brightness based on a value related to a ratio of the brightness headroom to the highest brightness value, generating an adjusted backlight level for the backlight, the adjusted backlight level being based on a ratio of the highest brightness value to the maximum brightness level.

2. The method as claimed in claim 1, wherein the highest brightness value is identified by analyzing a predefined region of the image for the highest brightness value.

3. The method as claimed in claim 2, wherein the predefined region is selected from one of alternating rows and a central region in the display.

4. The method as claimed in claim 1, wherein the highest brightness value is identified when a pixel in the image having the highest brightness value is within a predetermined number of pixels to another pixel in the image having a brightness that is within a predetermined range of the highest brightness value.

5. The method as claimed in claim 1, wherein the highest brightness value is identified from a greyscale representation of the image and the greyscale representation has been adjusted according to a gamma value.

6. The method as claimed in claim 5, wherein the greyscale representation provides a weight to favour green values in the image.

7. The method as claimed in claim 1, further comprising adjusting the adjusted backlight level to account for ambient light conditions surrounding the device by increasing the adjusted backlight level as the ambient light conditions increase up to a certain point and deactivating the backlight the ambient conditions past the certain point.

8. The method as claimed in claim 1, further comprising repeating the method when the image is replaced by another image on the display and the another image contains changes over the image in more than a predetermined portion of the image.

9. The method as claimed in claim 1, wherein:

the display is displaying a video image; and the highest brightness value is identified when a pixel in the image having the highest brightness value has a brightness value that is within a predetermined range of the highest brightness value in an image that is either before or after the image in the video image.

10. The method as claimed in claim 1, further comprising generating the image on the display using the backlight level if the brightness headroom does not exceed the predetermined threshold.

11. The method as claimed in claim 1, wherein in identifying the highest brightness value, the predefined region is selected from one of alternating rows and a central region in the display.

12. An electronic device, comprising:

a display for displaying images;

an image processing module to identify a highest brightness value of a pixel in an image for generation on the display and to determine a brightness headroom value for the image based on a value related to a ratio of the brightness headroom to the highest brightness value for the display;

a backlight adjustment module to provide an adjusted backlight level for the adjusted image, the adjusted backlight level being based on a ratio of the highest brightness value to a maximum brightness level for the display; and a backlight system to provide a backlight for the display at the adjusted backlight level.

13. The electronic device as claimed in claim 12, wherein the backlight adjustment module decreases the adjusted backlight level by a factor relating to a current backlight level for the backlight system and the brightness headroom.

14. The electronic device as claimed in claim 12, wherein the image processing module scans at least a part of pixels in the image to identify the highest brightness value.

15. The electronic device as claimed in claim 14, wherein the image processing module assesses whether a pixel in the image having the highest brightness value is within a preset number of pixels to another pixel having a comparable brightness before identifying the highest brightness value as being represented by the pixel.

16. The electronic device as claimed in claim 12, wherein the image processing module identifies the highest brightness value from a greyscale representation of the image and the greyscale representation has been corrected according to a gamma curve.

17. The electronic device as claimed in claim 12, wherein the backlight adjustment module adjusts the adjusted backlight level to account for an ambient light conditions obtained from a light sensor for the device to increase a current backlight level as the ambient light conditions increase up to a certain point and to deactivate the backlight when the ambient light conditions pass the certain point.

* * * * *